US009540841B2

(12) United States Patent
Vanderick

(10) Patent No.: US 9,540,841 B2
(45) Date of Patent: Jan. 10, 2017

(54) HANDLE MECHANISM

(71) Applicant: Frans Jan Renaat Vanderick, Halen (BE)

(72) Inventor: Frans Jan Renaat Vanderick, Halen (BE)

(73) Assignee: Frans Jan Renaat Vanderick, Halen (BE)

( * ) Notice: Subject to any disclaimer, the term of this patent is extended or adjusted under 35 U.S.C. 154(b) by 13 days.

(21) Appl. No.: 14/655,038

(22) PCT Filed: Dec. 23, 2013

(86) PCT No.: PCT/BE2013/000067

§ 371 (c)(1),
(2) Date: Jun. 23, 2015

(87) PCT Pub. No.: WO2014/100861

PCT Pub. Date: Jul. 3, 2014

(65) Prior Publication Data

US 2015/0345174 A1 Dec. 3, 2015

(30) Foreign Application Priority Data

Dec. 24, 2012 (BE) ..... 2012/0878

(51) Int. Cl.
*E05B 5/00* (2006.01)
*E05B 1/04* (2006.01)
(Continued)

(52) U.S. Cl.
CPC ..... *E05B 5/006* (2013.01); *E05B 1/0015* (2013.01); *E05B 1/04* (2013.01); *E05B 5/00* (2013.01);
(Continued)

(58) Field of Classification Search
CPC ..... A47B 95/02; A47B 2095/021; A47B 2095/022; A47B 2095/023; A47B 2095/024; A47B 2095/025; A47B 2095/027; E05B 1/0015; E05B 1/0038; E05B 1/0046; E05B 1/04; E05B 2001/0023; E05B 5/00; E05B 5/003; E05B 5/006; Y10T 16/458; Y10T 16/462
See application file for complete search history.

(56) References Cited

U.S. PATENT DOCUMENTS 2,497,624 A * 2/1950 Nelson ..... E05C 1/145 292/166
3,070,830 A * 1/1963 Schirmer ..... A47B 95/02 16/416
(Continued)

FOREIGN PATENT DOCUMENTS

CA 2685521 A1 11/2008
DE 71 11 900 U 6/1971
(Continued)

*Primary Examiner* — Jeffrey O Brien
(74) *Attorney, Agent, or Firm* — TechLaw LLP

(57) ABSTRACT

Handle mechanism provided for mounting in an opening extending wholly through a door, the handle mechanism comprising a first plate for closing the opening at the position of a first side of the door, a second plate for closing the opening at the position of a second side of the door and an intermediate plate placed between the first and second plates, wherein the first and the second plate are each connected via spring means to the intermediate plate so that each of the first and the second plate are movable substantially against the intermediate plate by an external force, wherein the intermediate plate is provided for movable placing in the door so as to increase an overall space for movement of each of the first and the second plate.

23 Claims, 3 Drawing Sheets

(51) Int. Cl.
*E05B 1/00* (2006.01)
*E05B 5/02* (2006.01)

(52) U.S. Cl.
CPC ..... *E05B 5/003* (2013.01); *E05B 2001/0023* (2013.01); *Y10T 16/458* (2015.01)

(56) References Cited

U.S. PATENT DOCUMENTS

| | | | | |
|---|---|---|---|---|
| 4,895,403 | A * | 1/1990 | Osenkowski | E05B 85/107 16/412 |
| 7,552,954 | B2 * | 6/2009 | Rozo | E05B 5/00 292/143 |
| 8,959,966 | B2 * | 2/2015 | Clark | E05B 1/0038 292/251.5 |
| 8,960,734 | B2 * | 2/2015 | Camp | E05B 1/0038 292/193 |
| 2012/0291359 | A1 * | 11/2012 | Hans | E05B 1/00 49/449 |

FOREIGN PATENT DOCUMENTS

| | | | |
|---|---|---|---|
| EP | 2 080 449 | A1 | 7/2009 |
| GB | 485 630 | A | 5/1938 |
| JP | H10 131552 | A | 5/1998 |
| JP | 2001 241222 | A | 9/2001 |

* cited by examiner

HANDLE MECHANISM

The invention relates to a handle mechanism provided for mounting in an opening extending wholly through a door. The invention relates particularly to a handle mechanism for a sliding door.

Sliding doors are generally known and in common use. Handle mechanisms for sliding doors are formed such that a force can be applied in two horizontal directions for the purpose of respectively sliding open and sliding shut the sliding door. Such handle mechanisms often mar the aesthetic appearance of the sliding door and leave a negative visual impression.

Invisible handles are known for conventional doors. Invisible handles are characterized in that they are fully integrated into the door and have no protruding parts. The operating element of such an invisible handle is typically formed as a plate placed in the plane of a side of the door and having the same colour and texture as the side of the door. The plate is hereby wholly assimilated visually into the side of the door and is referred to as being 'invisible'.

Although invisible handles are known for conventional doors, such handles are not suitable for sliding doors because the known mechanism of an invisible handle for conventional doors does not allow operation in two horizontal directions.

It is an object of the invention to propose a new handle mechanism suitable for, among other purposes, forming an invisible handle in a sliding door.

The invention provides for this purpose a handle mechanism provided for mounting in an opening extending wholly through a door, the handle mechanism comprising a first plate for closing the opening at the position of a first side of the door, a second plate for closing the opening at the position of a second side of the door and an intermediate plate placed between the first and second plates, wherein the first and the second plate are each connected via spring means to the intermediate plate so that each of the first and the second plate are movable substantially against the intermediate plate by an external force, wherein the intermediate plate is provided for movable placing in the door so as to increase an overall space for movement of each of the first and the second plate.

The handle mechanism according to the invention comprises two plates, each closing a side of the door. The two plates are each connected via spring means to an intermediate plate, and each of the two plates can thus be pressed inward substantially against the intermediate plate. In addition, the intermediate plate is movable. Not only will for instance the first plate move as a result against the intermediate plate when the first plate is pressed, but the intermediate plate will also co-displace with the first plate in the direction of the second plate. The result hereof is that the overall space for movement of the first and second plates is greater than the space for movement between this plate and the intermediate plate. If the intermediate plate were fixed, each of the first and second plates would only have a space to move of less than 50% of the thickness of the door. However, because the intermediate plate is movable according to the invention, each of the first and second plates have a space for movement which in the transverse direction is greater than 50% of the thickness of the door. A firm grip on the door is hereby made possible along two sides of the door when the handle is operated.

The intermediate plate is preferably retained in a guide, which guide limits the space for movement of the intermediate plate such that said overall space for movement is limited to a predetermined maximum. If there were too much space for movement, the first or second plate, when tilted within the space for movement, could move through the opening of the door and thus become disassembled in uncontrolled manner. In order to prevent this, a maximum space for movement is predetermined inside which the first and second plates can each move without risk of undesired disassembly. The overall space for movement is limited here by limiting the space for movement of the intermediate plate via the guide. Owing to the more limited space for movement, the overall space for movement will still be greater than if the intermediate plate were to be fixed, since the intermediate plate can still co-displace, albeit to a limited extent, with the movement of the first and second plates. The overall space for movement is nevertheless limited to a predetermined maximum by the guide such that the first and second plates cannot move too far, so as to guarantee proper functioning of the handle mechanism.

The door is preferably at least partially hollow at the position of the opening, and the handle mechanism comprises a frame in order to at least partially fill said cavity. By providing a frame the inner side of the opening can be finished and be provided so as to fulfil predetermined functions and display predetermined properties.

Said frame preferably comprises said guide. The guide limits the space for movement of the intermediate plate and is formed in the frame. The guide can be formed here as one or more grooves in the frame in which protrusions of the intermediate plates can move. By providing the guide in a frame the guide can be manufactured and mounted in the opening in simple manner.

The frame is preferably provided for the purpose of covering an inner side of the opening such that the door can be operated via said frame when the first or second plate is pressed inward. The frame is preferably provided here with a hollow or concave inner side so that fingers of a person operating the door have a good grip on the frame in order to operate the door.

The frame is preferably substantially rectangular and comprises at least four and preferably eight elements, each forming a side of the rectangle. Forming the frame from four or eight elements enables easy mounting of the frame. The frame is typically mounted in a cavity in the door, wherein the elements forming the frame are carried through the opening in the door into the cavity. Constructing the frame from four and preferably eight elements makes it possible to provide a frame which can be constructed in simple manner in a cavity in the door through the opening of the door.

The frame preferably has guide surfaces for guiding the first and second plates, these guide surfaces being at least partially movable under the influence of a force in order to thus allow mounting of the first and second plates. In everyday operation the guide surfaces will prevent the first and second plates moving outside their space for movement. This prevents undesired movement of the first and/or second plate through the opening in the door. During mounting however the first and second plates do have to be inserted through the opening of the door into the door. In order to facilitate mounting, the guide surfaces are provided with a movable part which can be moved under the influence of a force. The first and second plates can thus be mounted in the door by pushing the guide surfaces out of their (normal) rest position. Once the first and second plates have been mounted and there is no longer any force on the guide surfaces of the frame, the first and second plates can no longer be moved out of the door (at least without considerable external force).

Mounting of the first and second plates is hereby made possible while ensuring proper operation of the handle mechanism.

At least one of the first and second plates preferably comprises a surface provided to lie in the plane of the side of the door for the purpose of closing the opening, which surface preferably has the same colour and texture as the side of the door. Providing the plate with such a surface creates a uniform visual impression of the surface of the door and the handle. As a result the handle will be visually wholly assimilated into the door and so be 'invisible'.

The first and second plates preferably have dimensions greater than dimensions of the opening at the position of the side of the door such that these plates are provided so as to come to lie against an edge of the opening in the door. Giving the first and second plates dimensions greater than the openings in the door makes it possible to prevent the first and second plates moving out of the door through the opening. The first and second plates can be mounted through the opening via a tilting movement. In normal operation however, the greater dimensions of the plates prevent them moving through the opening.

The door is preferably a sliding door, and each of the first and second plates are movable on two opposite sides by an external force such that the handle can be operated for sliding of the door in two directions. Because the first and second plates are movable on each of two opposite sides they lie wholly free and "float" in the handle mechanism. The "floating plates" are held in place here by the spring means and the guides in the frame.

The invention further relates to a door, preferably a sliding door, with an opening extending wholly through the door and wherein a handle mechanism according to the invention is mounted in the opening.

The invention further relates to a method for mounting a handle mechanism according to the invention in an opening extending wholly through a door, wherein the method comprises the following steps of:

- providing at least one of a first, a second and an intermediate plate with spring means;
- placing the intermediate plate in said opening;
- placing the first and second plates through respectively the opening at the position of a first side of the door and the opening at the position of the second side of the door. A handle mechanism according to the invention is in this way placeable in simple manner.

At least a part of the frame is preferably placed before placing of the intermediate plate. By placing the frame first at least a part of the guide which guides the intermediate plate is placed, and the intermediate plate can be positioned during placing in the guide.

Placing of the first and second plates preferably comprises of applying an external force which at least partially moves guide surfaces of a frame in order to thus place a first and second plate through the opening in the door. The first and second plate can hereby be mounted through the opening and nevertheless be prevented from moving out of the opening in undesirable manner during normal operation. This is because the guide surfaces take up their normal operative position when the external force is withdrawn. In this operative position the first and second plates cannot move through the opening.

The invention will now be further described on the basis of an exemplary embodiment shown in the drawing.

In the drawing.

The same or similar elements are designated in the drawing with the same reference numeral.

Figure 1:
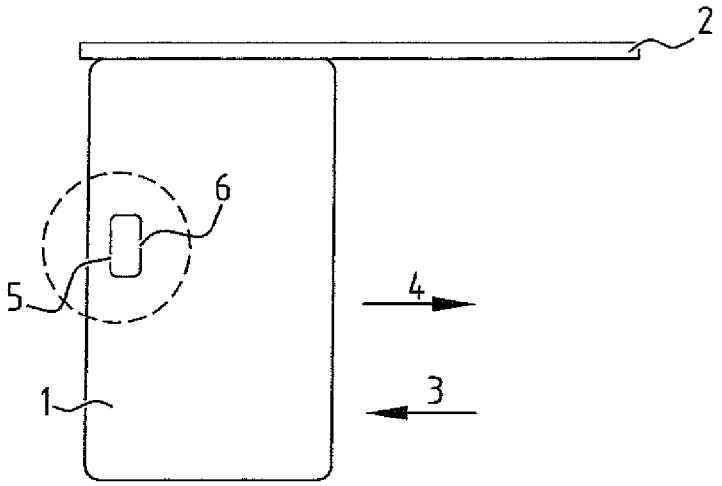
FIG. 1 shows a sliding door with invisible handle according to the invention.

FIG. 1 shows a door 1 mounted on a rail system 2 to enable sliding in two directions 3 and 4. The door has an opening provided for the purpose of operating the door. When a user wishes to slide the door in direction 3, the user will use surface 5 at the opening as stop in order to exert a force on the door in direction 3. Similarly, the user wishing to move the door in direction 4 will use surface 6 of the opening as stop surface on which to exert a force in order to move the door in direction 4. This shows that, in order to enable operation of a sliding door in two directions 3 and 4, two opposite stop surfaces 5 and 6 must also be provided. The invention provides a handle mechanism with which an invisible handle can be formed which gives access to two opposite stop surfaces 5 and 6.

Although the handle mechanism has been developed particularly for sliding doors and for the purpose of forming an invisible handle, it will be apparent that the handle mechanism is also applicable to conventional doors, to gates, to hatches and other elements provided for the purpose of closing a space.

Invisible handle is defined within the context of this invention as a handle which is visually assimilated into the surface in which the handle is placed. It will be apparent here that the handle is visually discernible, and so is visible, but that the visual distinction between the surface and the handle is minimal. Although the handle mechanism according to the invention is highly suitable for forming invisible handles, the invention is not limited thereto. The handle mechanism according to the invention can likewise be applied for the purpose of forming a visible handle, for instance a handle with a colour greatly differing from the colour of the surface into which it is incorporated.

Figure 2:
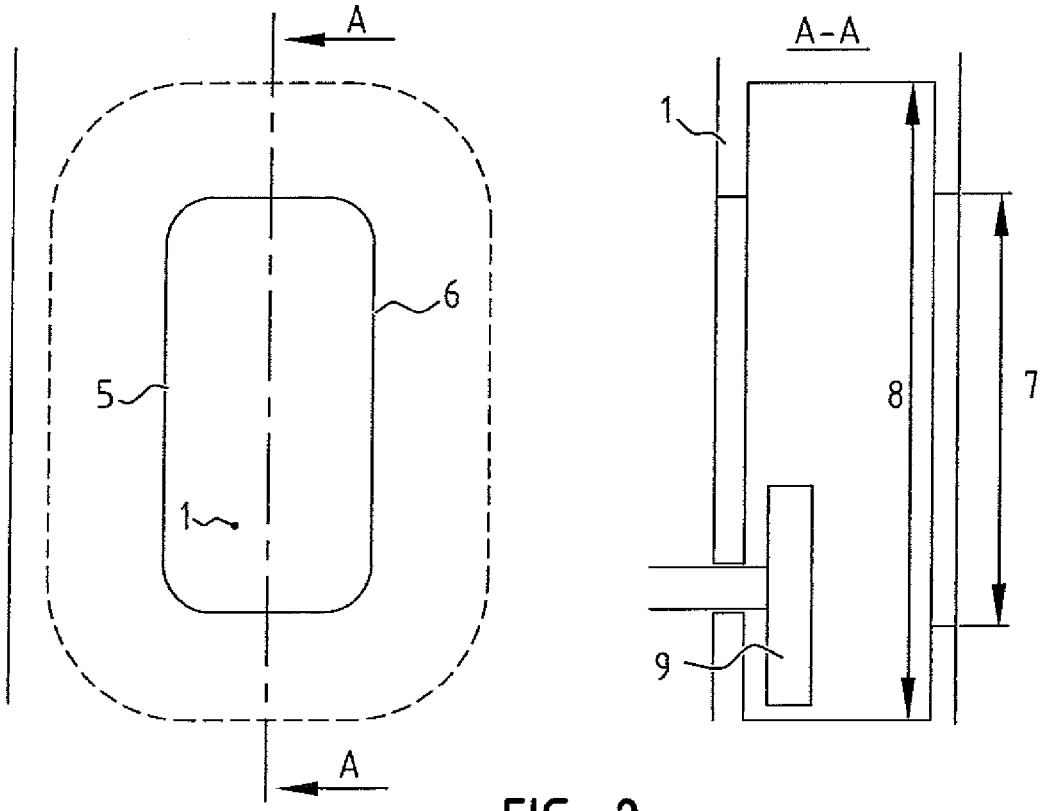
FIG. 2 shows a front view and a cross-sectional view of an opening in a door.

FIG. 2 shows an opening which extends wholly through a door and is suitable for placing of a handle mechanism according to an embodiment of the invention. The opening is substantially rectangular with two upright edges 5 and 6 having a height 7. The opening also has a width which is preferably smaller than the height. The height 7 of the opening is chosen here such that upright surfaces 5 and 6 are large enough to be operated in simple manner. The height 7 is preferably greater than 5 cm, more preferably greater than 10 cm, most preferably greater than 15 cm. The height 7 is further preferably smaller than 30 cm, more preferably smaller than 25 cm, most preferably smaller than 20 cm. The door is preferably hollowed out at the position of the opening, thereby creating a cavity with dimensions 8 which are greater than the dimensions of opening 7. Such a cavity can be made via a cutter 9 as shown in FIG. 2. The thus created cavity provides space for components of the handle mechanism according to a preferred embodiment of the invention.

Figure 3A:
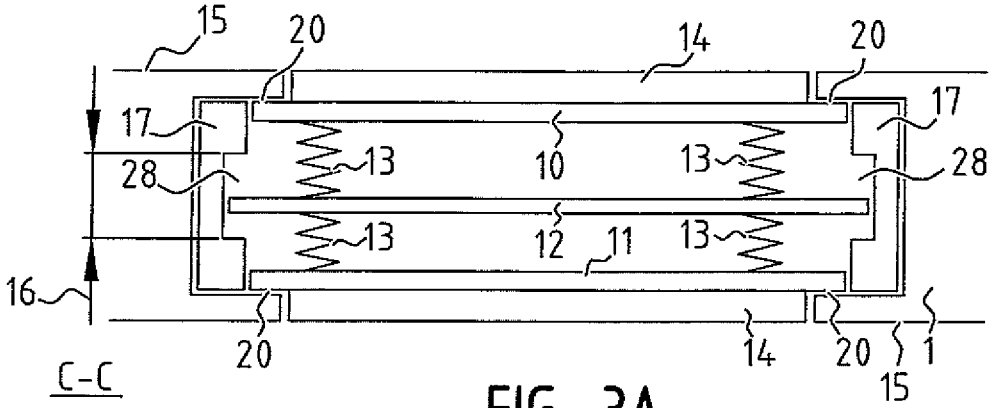
FIG. 3 shows a longitudinal section of a handle mechanism according to an embodiment of the invention mounted in an opening.

FIG. 3 shows a cross-section of a door 1 in which a handle mechanism according to an embodiment of the invention is placed. The handle mechanism comprises a first plate 10, a second plate 11 and an intermediate plate 12. First plate 10 is provided for the purpose of closing an opening through door 1 at the position of a first side of the door. Second plate 11 is provided for the purpose of closing the opening through door 1 at the position of the second side of the door, wherein the second side lies opposite the first side of the door. Intermediate plate 12 is provided for placing between first plate 10 and second plate 11.

First plate 10 is connected via spring means 13 to a first side of intermediate plate 12. Second plate 11 is likewise connected via spring means 13 to another side of intermediate plate 12. First plate 10, second plate 11 and intermediate plate 12 are preferably placed floating in door 1. Floating is defined as not being fixedly connected to door 1 in any way.

Figure 3B:
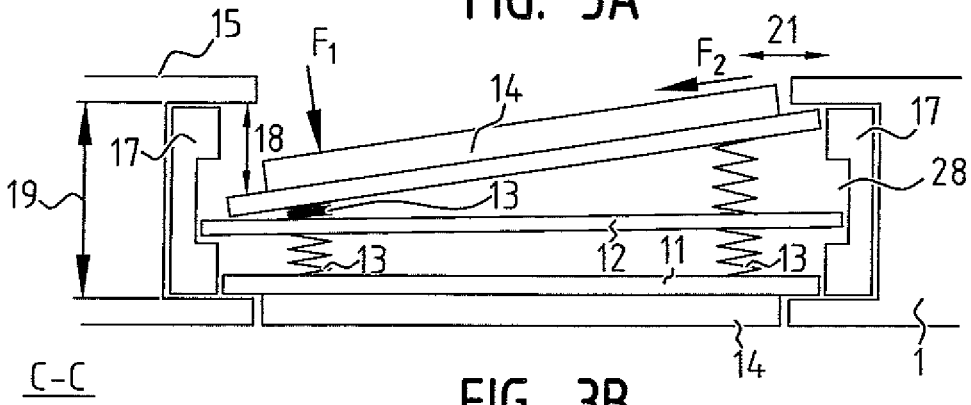

First plate 10 is connected via spring means 13 to intermediate plate 12 such that first plate 10 can be pressed substantially against intermediate plate 12 by an external force F1 FIG. 3B shows here how force F1 is exerted on the left-hand side of first plate 10, whereas exerting a similar force on the right-hand side of first plate 10 will cause a movement of first plate 10 toward intermediate plate 12 on the right-hand side. Spring means 13 are provided here in order to press the first plate away from intermediate plate 12 and thus press it against an inner edge of the opening in door 1 in order to close it. Second plate 11 is connected in wholly similar manner to intermediate plate 12 via spring means 13.

Spiral springs are preferably applied as spring means. Alternative spring elements such as leaf springs are however also applicable in the invention. Four independent spring elements are preferably provided between first plate 10 and intermediate plate 12, and four further spring means 13 between second plate 11 and intermediate plate 12. Each spring element is preferably placed here close to a corner of the substantially rectangular first plate 10 and second plate 11. Spring means 13 are preferably connected to only one of first plate 10 and intermediate plate 12 (in the case of spring means 13 between first plate 10 and intermediate plate 12) or to only one of second plate 11 and intermediate plate 12 (in the case of spring means 13 between second plate 11 and intermediate plate 12). Securing spring element 13 to only one of the two plates between which the spring element acts gives the spring element the freedom of movement to exert its pushing force. The spring element will hereby not come to lie in a twisted position, or at least less easily so.

Each of first plate 10 and second plate 11 are preferably provided with a finishing layer 14. Finishing layer 14 is formed here such that it lies in line with side 15 of door 1. Finishing layer 14 preferably has the same colour and texture as side 15 of door 1. Finishing layer 14 hereby ensures that first and second plates 10, 11 are visually assimilated into surface 15 of door 1, and thereby forms invisible handles.

Intermediate plate 12 is mounted movably in door 1. The space for movement of intermediate plate 12 is preferably limited. In FIG. 3 the movement limitation is formed by guides 28. Guides 28 form a groove of a predetermined length 16. Intermediate plate 12 is provided so as to engage in groove 28. Intermediate plate 12 preferably has protrusions complementary in shape and size to groove 28 so that the protrusions of the intermediate plate can move in groove 28. The movement of intermediate plate 12 can alternatively be limited by modifying the thickness of intermediate plate 12. Making intermediate plate 12 thicker will likewise make it possible to limit the overall space for movement of first plate 10.

FIG. 3B shows the effect of the movement of intermediate plate 12 when an external force F1 is applied by the movement of first plate 10. The overall space for movement of first plate 10 is the sum of the space for movement between first plate 10 and intermediate plate 12 plus the space for movement (on one side) of intermediate plate 12. First plate 12 can hereby move over a distance 18 which is greater than half the thickness 19 of the door. By limiting the space for movement of intermediate plate 12 it is possible to prevent first plate 10 detaching from the door through the opening. Applying a force F1 to first plate 10 does after all cause this first plate 10 to tilt (as shown in FIG. 3B). This tilting results in a clearance in direction 21. The clearance 21 becomes greater here as the space for movement 18 of first plate 10 becomes greater, i.e. the greater the angular displacement, the greater the clearance in direction 21. When this clearance in direction 21 becomes greater than the projecting portion 20 of first plate 10 relative to the opening in door 1, the plate can move outward through the opening. In order to prevent this, the space for movement 18 of first plate 10 is limited to a predetermined space for movement, wherein correct functioning of the handle mechanism can be guaranteed. The predetermined space for movement will particularly take into account the clearance in direction 21 which occurs as a result of tilting first plate 10 inside the space for movement, such that the clearance does not become greater than projecting portion 20.

The first plate has dimensions greater than the dimensions of the opening, first plate 10 and second plate 11 preferably have a length greater than the height 7 of the opening in door 1. The first and second plates 10, 11 hereby have a projecting portion 20 relative to the opening. This projecting portion prevents first plate 10 and second plate 11 being able to move outward through the opening. This projecting portion 20 further ensures a correct positioning of the first plate and second plate, in particular of the finishing layer 14 thereof; relative to surface 15 of door 1.

Figure 4:
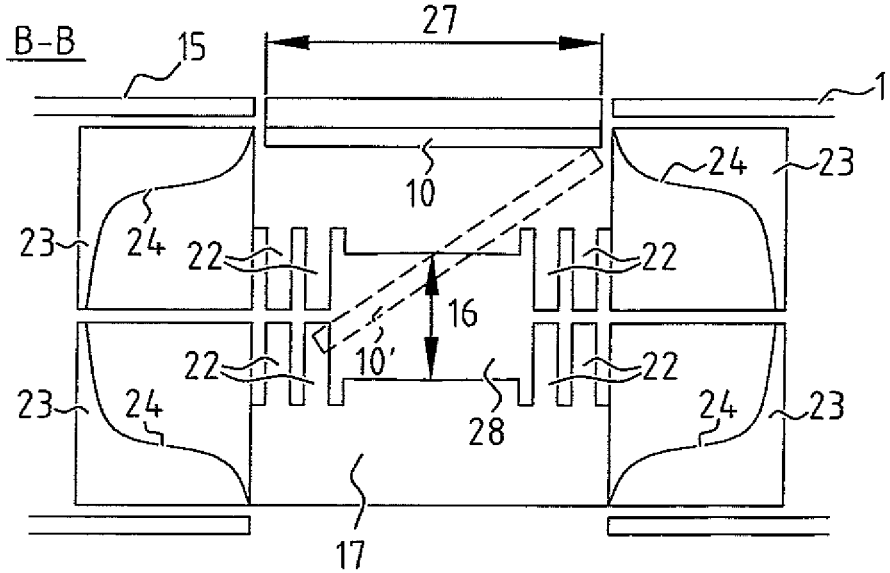
FIG. 4 shows a cross-section of a handle mechanism according to an embodiment of the invention.

A frame 17 is preferably provided in the cavity of the door. This frame 17 can comprise the guides 28 for limiting the space for movement of intermediate plate 12. FIG. 4 shows different frame elements 17 and 23. Frame elements 23 are preferably placed here in the upright direction and frame elements 17 are placed on an upper and lower side of the handle mechanism. FIG. 4 shows a section (in the case of normal placing of a handle mechanism according to the preferred embodiment of the invention in a door opening) along the horizontal plane. Upright frame elements 23 are therefore shown in cross-section, while frame element 17 is shown in front view. Frame element 17 of FIG. 4 is the same frame element as shown in schematic cross-section in FIG. 3B. FIG. 4 shows frame element 17 having in a central zone the guide 28 which is formed as an opening in frame 17. A protrusion of intermediate plate 12 can move in this opening over a distance 16 which is defined by the size of opening 28. Guide surfaces are formed adjacently of opening 28. These guide surfaces, which are not shown in FIG. 3B, hold the first and the second plate 10, 11 in place, at least in direction 21. These guide surfaces of frame element 17 prevent the first and second plates 10, 11 moving through the opening during normal use of the handle mechanism.

The guide surfaces of frame element 17 preferably take a movable form. FIG. 4 shows how the guide surfaces are formed at least partially by tongues 22 which can be bent by a force F2 (shown in FIG. 3B) so as to displace the guide surface. By applying a considerable force F2 more clearance is in this way created in direction 21 for the first or second plate 10, 11. The plates can in this way be moved through the opening under the influence of force F2, for instance for the purpose of assembling or disassembling the handle.

FIG. 4 further shows that first plate 10 has dimensions 27 in its width direction which are substantially equal to the horizontal dimensions of the openings in door 1. A projecting portion is not therefore formed since the plate cannot move through the opening of the door anyway owing to the projecting portion in the upright direction as shown in FIG. 3.

FIG. 4 shows how the upright frame elements 23 are provided with a surface 24 which improves operation of the handle. Inner surface 24 thus has a concave form which has a convex rounding at the edge of the opening in order to thus greatly enhance the grip of fingers on surface 24. The form of surface 24 of frame elements 23 further functions as stop for first plate 10 and second plate 11 in order to position these plates correctly relative to the opening in door 1.

FIG. 4 further shows that the frame consists of eight elements (six of which are shown and two of which are invisible due to the direction of view of the cross-section). The frame is formed on each side of the door by four elements, being two upright frame elements 23 and two end frame elements. Constructing the frame from eight frame elements has advantages in respect of assembly. The frame can thus be constructed at the position of one side of the door, after which the intermediate plate is placed. The other side of the door can then be provided with frame elements in order to thus confine the intermediate plate in its space for movement. A frame can alternatively also be constructed from only four frame elements, two upright frame elements and two end frame elements.

Figure 5:
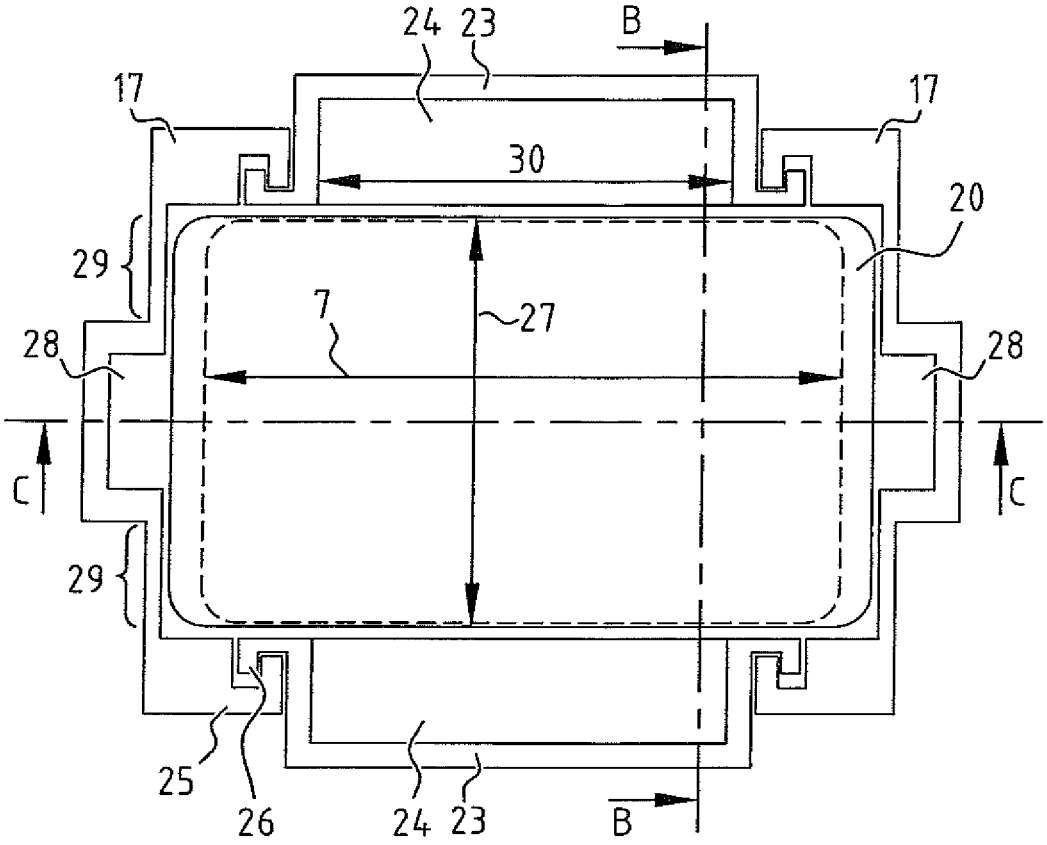
FIG. 5 shows a plane section of a handle mechanism according to an embodiment according to the invention.

FIG. 5 shows a schematic view of a section of the handle mechanism according to a preferred embodiment of the invention. The figure shows the different frame elements 17 and 23. The figure shows here that frame elements 23 engage via a hook part 23 in grooves 26 of frame elements 17. In this simple manner the frame can be constructed with strict tolerances in respect of size. FIG. 5 shows that frame element 17 comprises groove 28 and also comprises the tongues at the position of reference numeral 29. As alternative to tongues for forming a movable guide surface, frame element 17 can be formed from an elastic material and take a form such that the guide surface is moved by a force F2.

FIG. 5 further shows that upright frame elements 23 have an inner surface 24 over a distance 30 which is smaller than the opening 7 in the door. Opening 7 in the door is then in turn smaller than the outer dimensions of the first plate, whereby a projecting portion 20 is formed.

During placing of the handle mechanism according to the invention frame elements 17 will typically be placed first through the opening in the door. Frame elements 23 will subsequently be mounted and connected to the end frame elements 17. Springs 13 are further connected either to the first and second plate or to the intermediate plate, or in other manner such that spring elements 13 can extend between first plate and intermediate plate and between second plate and intermediate plate. The intermediate plate will further be placed, preferably with protrusions in grooves 28, in order to define the space for movement of the intermediate plate. The first plate and second plate are then mounted through the opening in the door by applying a force F2.

The operation of the handle mechanism according to the invention is mainly described above via first plate 10. The handle mechanism according to the invention is however preferably formed symmetrically relative to a plane of symmetry extending at the position of the intermediate plate. Second plate 11 thus functions in identical manner to first plate 10. Door 1 can hereby be opened from two sides. This is because the handle mechanism reacts in the same way on the two sides of door 1.

The handle mechanism according to the invention is preferably also manufactured symmetrically relative to an upright plane lying transversely relative to the plane of the door. The operation of the handle mechanism when the door is opened in a first horizontal direction is hereby identical to the operation of the handle mechanism when this door is moved in the other horizontal direction. As a result of the specific construction of the handle mechanism, preferably the symmetry, two similar stop surfaces 5, 6 are formed on either side of the door. The door can thus be moved in two directions from either side. The handle mechanism is further preferably formed symmetrically around a lying plane. This greatly simplifies the manufacture of the handle mechanism since this symmetry makes it irrelevant how a plate is mounted (right way up or upside down), and this also reduces the number of different components required to construct a handle mechanism according to the invention. The handle mechanism is most preferably formed symmetrically around the three different planes of symmetry.

The invention is described above on the basis of exemplary embodiments which are not intended to be limitative of the invention but intended solely to provide a better understanding of the protected invention. The scope of protection is not therefore affected by the description or by the figures, and is defined solely by the appended claims.

The invention claimed is:

1. Handle mechanism provided for mounting in an opening extending wholly through a door, the handle mechanism comprising a first plate for closing the opening at the position of a first side of the door, a second plate for closing the opening at the position of a second side of the door and an intermediate plate placed between the first and second plates, wherein the first and the second plate are each connected via spring means to the intermediate plate so that each of the first and the second plate are movable substantially against the intermediate plate by an external force, wherein the intermediate plate is movable in the door so as to increase an overall space for movement of each of the first and the second plate.

2. Handle mechanism as claimed in claim 1, wherein the intermediate plate is retained in a guide, which guide limits the space for movement of the intermediate plate such that said overall space for movement is limited to a predetermined maximum.

3. Handle mechanism as claimed in claim 2, wherein the door is at least partially hollow creating a cavity at the position of the opening, and wherein the handle mechanism comprises a frame in order to at least partially fill said cavity.

4. Handle mechanism as claimed in claim 3, wherein said frame comprises said guide.

5. Handle mechanism as claimed in claim 3, wherein said frame is provided for the purpose of covering an inner side of the opening such that the door can be operated via said frame when the first or second plate is pressed inward.

6. Handle mechanism as claimed in claim 3, wherein the frame is substantially rectangular and comprises at least four elements, each forming a side of the rectangle.

7. Handle mechanism as claimed in claim 3, wherein the frame has guide surfaces for guiding the first and second plates, these guide surfaces being at least partially movable under the influence of a force in order to thus allow mounting of the first and second plates.

8. Handle mechanism as claimed in claim 1, wherein at least one of the first and second plates comprises a surface provided to lie in the plane of the side of the door for the purpose of closing the opening, which surface preferably has the same colour and texture as the side of the door.

9. Handle mechanism as claimed in claim 1, wherein the first and second plates have dimensions greater than dimensions of the opening at the position of the side of the door such that these plates are provided so as to come to lie against an edge of the opening in the door.

10. Handle mechanism as claimed in claim 1, wherein the door is a sliding door, and wherein each of the first and second plates are movable on two opposite sides by an external force such that the handle can be operated for sliding of the door in two directions.

11. A method for mounting a handle mechanism in an opening extending wholly through a door, the method comprising;

providing a first plate for closing the opening at the position of a first side of the door, a second plate for closing the opening at the position of a second side of the door and an intermediate plate placed between the first and second plates, wherein the first and the second plate are each connected via spring means to the intermediate plate so that each of the first and the second plate are movable substantially against the intermediate plate by an external force, wherein the intermediate plate is movable in the door so as to increase an overall space for movement of each of the first and the second plate;

placing the intermediate plate in said opening;

placing the first and second plates through respectively the opening at the position of a first side of the door and the opening at the position of the second side of the door.

12. The method as claimed in claim 11, wherein the door is at least partially hollow creating a cavity at the position of the opening and the handle mechanism comprises a frame in order to at least partially fill said cavity, and wherein the method further comprises placing at least a part of the frame before placing the intermediate plate.

13. The method as claimed in claim 12, wherein placing of the first and second plates comprises applying an external force which at least partially moves guide surfaces of the frame in order to thus place the first and second plate through the opening.

14. A door with an opening extending wholly through the door, the door comprising a handle mechanism provided for mounting in the opening, the handle mechanism comprising a first plate for closing the opening at the position of a first side of the door, a second plate for closing the opening at the position of a second side of the door and an intermediate plate placed between the first and second plates, wherein the first and the second plate are each connected via spring means to the intermediate plate so that each of the first and the second plate are movable substantially against the intermediate plate by an external force, wherein the intermediate plate is movable in the door so as to increase an overall space for movement of each of the first and the second plate.

15. The door as claimed in claim 14, wherein the intermediate plate is retained in a guide, which guide limits the space for movement of the intermediate plate such that said overall space for movement is limited to a predetermined maximum.

16. The door as claimed in claim 15, wherein the door is at least partially hollow creating a cavity at the position of the opening , and wherein the handle mechanism comprises a frame in order to at least partially fill said cavity.

17. The door as claimed in claim 16, wherein said frame comprises said guide.

18. The door as claimed in claim 17, wherein said frame is provided for the purpose of covering an inner side of the opening such that the door can be operated via said frame when the first or second plate is pressed inward.

19. The door as claimed in claim 17, wherein the frame is substantially rectangular and comprises at least four elements, each forming a side of the rectangle.

20. The door as claimed in claim 17, wherein the frame has guide surfaces for guiding the first and second plates, these guide surfaces being at least partially movable under the influence of a force in order to thus allow mounting of the first and second plates.

21. The door as claimed in 14, wherein at least one of the first and second plates comprises a surface provided to lie in the plane of the side of the door for the purpose of closing the opening, which surface preferably has the same colour and texture as the side of the door.

22. The door as claimed in claim 14, wherein the first and second plates have dimensions greater than dimensions of the opening at the position of the side of the door such that these plates are provided so as to come to lie against an edge of the opening in the door.

23. The door as claimed in claim 14, wherein the door is a sliding door, and wherein each of the first and second plates are movable on two opposite sides by an external force such that the handle can be operated for sliding of the door in two directions.

* * * * *